US006729292B1

(12) United States Patent
Bock et al.

(10) Patent No.: US 6,729,292 B1
(45) Date of Patent: May 4, 2004

(54) OIL DEFLECTOR IN AN OIL PAN FOR AN INTERNAL COMBUSTION ENGINE

(75) Inventors: Heiko Bock, Abstatt (DE); Christian Keller, Plochingen (DE); Roland Nöll, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/679,524

(22) Filed: Oct. 6, 2000

(30) Foreign Application Priority Data

Oct. 6, 1999 (DE) ..... 199 48 227
Dec. 7, 1999 (DE) ..... 199 58 743

(51) Int. Cl.[7] ..... F02F 7/00
(52) U.S. Cl. ..... 123/195 C; 184/106
(58) Field of Search ..... 123/195 C; 184/106

(56) References Cited

U.S. PATENT DOCUMENTS 3,425,514 A 2/1969 Shier
4,270,497 A 6/1981 Valerio
4,519,348 A 5/1985 Hamilton
5,960,763 A 10/1999 Yamamura

FOREIGN PATENT DOCUMENTS

DE 74 10 986 7/1974
DE 40 11 759 A1 10/1990
DE 41 39 195 A1 6/1993

*Primary Examiner*—Noah P. Kamen
(74) *Attorney, Agent, or Firm*—Crowell & Moring LLP

(57) ABSTRACT

An oil deflector for an internal combustion engine has first and second oil-deflecting plates between a crankshaft and an oil pan. In order to configure the overall space, and in particular the overall height, of an oil-deflecting device so that it is as small as possible, it is proposed to arrange the oil-deflecting plates such that they overlap at a distance apart over the length of the crankcase. The longitudinal edge of the second oil-deflecting plate forms a main oil scraper edge. Strip-shaped ribs are arranged between the oil-deflecting plates, in their overlapping region, for the purpose of guiding oil in the direction of a suction point of the oil pan. The first oil-deflecting plate has apertures in the region of the width of a respective crank assembly assigned thereto. These apertures serve as secondary oil scraper edges.

12 Claims, 5 Drawing Sheets

Fig. 5
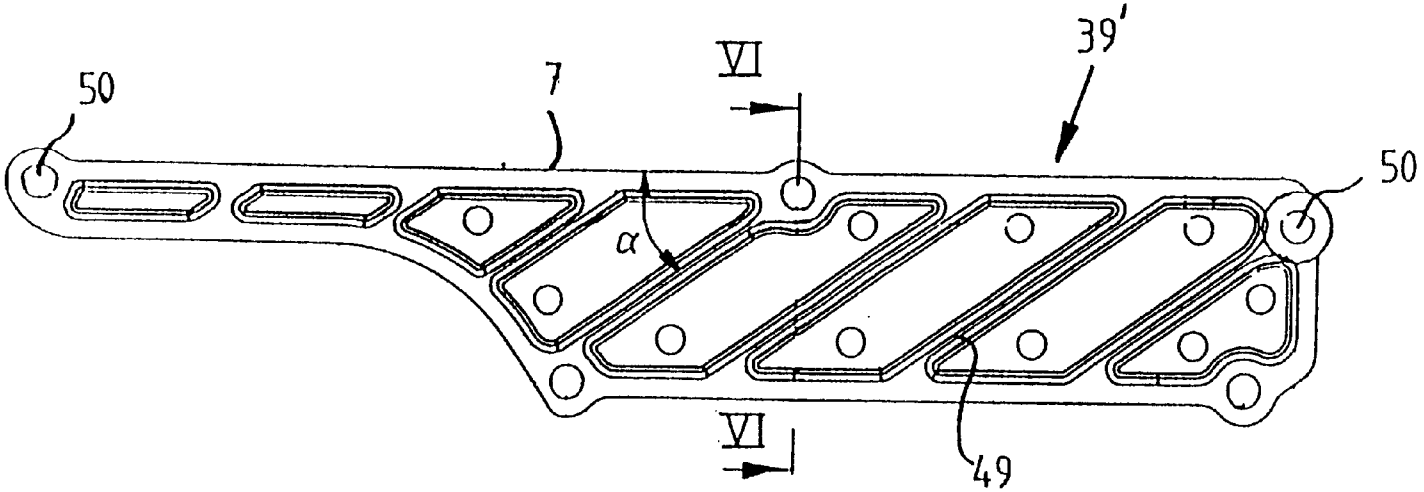
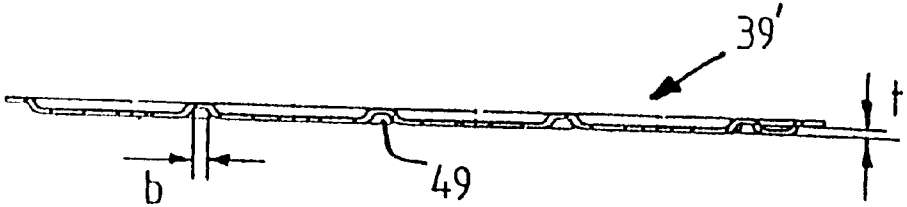
Fig. 6

OIL DEFLECTOR IN AN OIL PAN FOR AN INTERNAL COMBUSTION ENGINE

This application claims the priorities of German applications 199 48 227.6, filed Oct. 6, 1999, and 199 58 743.4, filed Dec. 7, 1999, the disclosures of which are expressly incorporated by reference herein.

BACKGROUND AND SUMMARY OF THE INVENTION

The present invention relates to an oil deflector in an oil pan for an internal combustion engine including a first oil deflecting plate and a second oil-deflecting plate between a crankshaft and an oil pan and in which the oil-deflecting plates overlap and form a channel in a particular region.

German Utility Model 74 10 986.7 discloses an oil deflector for an internal combustion engine. This oil deflector comprises an oil pan in which lubricating oil dropping into the oil pan is collected in a sump of the oil pan so as to be guided by an oil pump to the various sections of the internal combustion engine. In order to return the lubricating oil efficiently into the sump, in the known arrangement, provision is made to fasten deflecting plates onto integrally formed supporting surfaces of the oil pan by rivets, welding or similar types of fastening. The oil-deflecting plates are held on pipes or supporting surfaces protruding from the bottom of the oil pan. In order to use one pipe or supporting surface for both oil-deflecting plates, the oil-deflecting plates are held thereon in an overlapping manner. The oil-deflecting plates form oil-stripping edges, by way of a longitudinal edge in each case extending over the entire crankcase, in order to improve the oil separation at the crank assembly.

The known oil deflector has the disadvantage that additional supporting surfaces which protrude from the bottom of the oil pan are required for the fastening of the oil-deflecting plates, and a run-off slope has to be stamped into the oil pan in order to supply the oil to the suction point of the oil pump. Because of the special shaping, the oil pan is complicated to produce and has a large overall height.

The present invention has, as one object, the provision of an oil deflector of the type mentioned above but which is simple to produce and has a low overall height.

This object is achieved, in such an oil deflector, by having at least one longitudinal edge of the second oil-deflecting plate form a main oil scraper edge, and, in the particular region in which the oil-deflecting plates overlap, by arranging ribs between the oil-deflecting plates to guide oil in a direction of a suction point formed in the oil pan.

Several advantages of the subject matter of the invention can be seen, since an oil-deflecting device is provided which orientates the direction of the oil particles thrown off from the crank assembly, and the tangential impulse of the oil particles is changed into an impulse in the direction of the suction point of the oil pump. The air flow produced by the crank assemblies is used as a carrier air flow for transporting the oil in the direction of the suction point of the oil pump. The gradient of run-off slopes can be minimized or completely eliminated as a result, and the oil-deflecting device can be of compact design with a minimized overall height.

The oil-deflecting device is advantageously formed from two oil-deflecting plates extending in a strip-shaped manner over the length or over a partial length of the crankcase of the internal combustion engine. By way of one of their longitudinal edges in each case, the oil-deflecting plates rest here on opposite borders of the oil pan or of the crank housing, while their respectively other longitudinal edge extends in the crankcase of the internal combustion engine. The oil-deflecting plates overlap in the crankcase, the plates being at a distance from one another in the overlapping region and forming a channel for conducting oil chrough. The oil-deflecting plates, as viewed in the cross section of the oil deflector, are first of all guided horizontally from both borders of the oil pan and follow, at a distance, the contour of one or two connecting-rod arches of the internal combustion engine. The first oil-deflecting plate, as viewed in the direction of rotation of the crankshaft, is mounted here upstream of the second oil-deflecting plate and reaches under the latter, forming a channel, in the overlapping region. The second oil-deflecting plate forms, by way of its longitudinal edge which extends in the crankcase, a main oil scraper edge. In the region in which the oil-deflecting plates overlap, ribs, which are preferably strip-shaped, are guided from the first oil-deflecting plate to the second oil-deflecting plate, the ribs being orientated in the direction of the suction point of the oil pump by the main oil scraper edge. The ribs are arranged at discrete distances apart, preferably parallel to one another, and, together with the first and the second oil-deflecting plate, form channels. Instead of the ribs, it is also possible to use other elements which act in a flow-aligning manner, such as tubes or the like.

The oil-air flow produced by the rotation of the crankshaft is conducted through these channels, the oil being moved in the direction of the suction point of the oil pump by way of the ribs and by way of the air flow. The ribs preferably serve to connect the first and second oil-deflecting plates, resulting here in a flexurally rigid, box-shaped oil-deflecting device which does not require any further support in the crankcase. As a result, the oil pan itself can be configured such that it is simple and cost-effective in its shaping, since pipes or supporting surfaces and conducting ribs on the bottom thereof can be dispensed with. It may be expedient to form at least the first oil-deflecting plate or even the entire oil-deflecting device in one piece with the oil pan, for example from a light metal casting. Secondary oil scraper edges can be arranged on the first oil-deflecting plate, in each case in the region of the crank assemblies arranged directly above the latter, over the respective width of the corresponding crank assembly. The scraper edges scrape off oil coming off from the crank assembly and pass it to the oil pan. The secondary oil scraper edges are preferably aligned parallel to the longitudinal central axis of the oil-deflecting device and are formed by strip-shaped apertures in the first oil-deflecting plate. The apertures are surrounded by stiffening elements which are U-shaped in outline and in which, also, through holes penetrating the first oil-deflecting plate are arranged. Attached opposite the longitudinal central axis of the oil-deflecting device, on the second oil-deflecting plate, are stiffening elements which are U-shaped in outline and whose legs likewise extend from the oil-pan boundary towards the longitudinal central axis of the oil-deflecting device. Through holes which serve to receive tie rods are guided through the said legs and through the second oil-deflecting plate. The oil-deflecting device is secured to the engine block of the internal combustion engine by way of the tie rods.

Apertures are arranged between the stiffening elements on the first and second oil-deflecting plates. These apertures can be circular or elliptical in outline and serve to minimize the weight of the oil-deflecting device and as a flow-off opening for the air blown in between the oil pan and the oil-deflecting device by the crank assembly. Instead of these apertures, it is also possible for bead-like depressions to be provided which cover the bearing shells of the crank assembly.

BRIEF DESCRIPTION OF THE DRAWINGS

Exemplary embodiments of the invention are explained in greater detail below with reference to the drawing, in which:

FIG. 5 shows a plan of an upper plate position of a multi-piece oil-deflecting plate, FIG. 6 shows a cross section through the oil-deflecting plate arrangement along the line VI—VI in FIG. 5.

DESCRIPTION OF THE PREFERRED EMBODIMENTS

Figure 1:
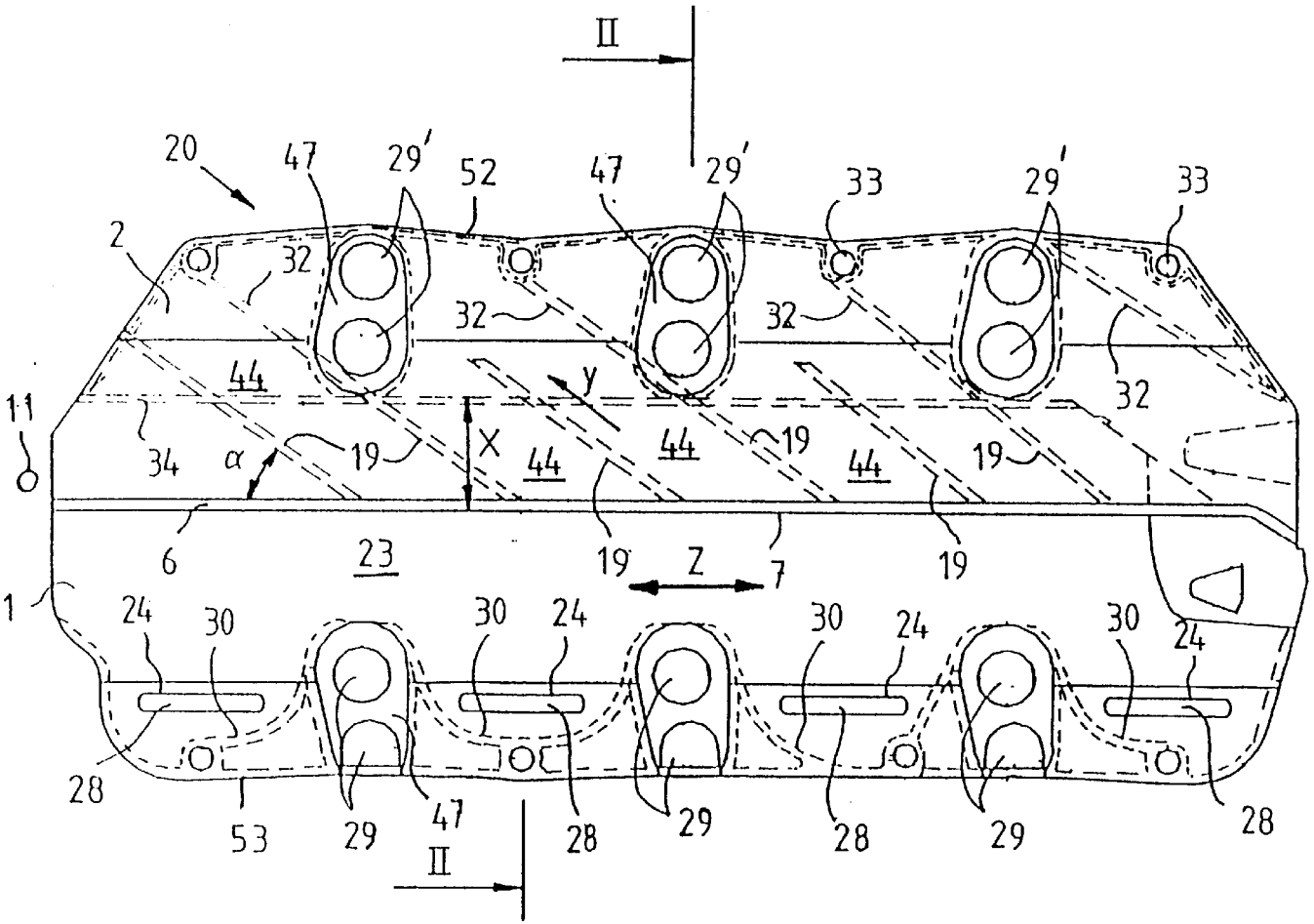
FIG. 1 shows a plan view of a first design of an oil-deflecting plate for an oil pan, which is formed in one piece.

FIG. 1 shows a plan view of an oil-deflecting device 20 which is formed in one piece from light metal as a casting, for example. The oil-deflecting device 20 essentially consists of a first oil-deflecting plate 1 and a second oil-deflecting plate 2 which are moulded to one another by way of the ribs 19 and the stiffening elements 32 as a metal casting. The entire oil-deflecting device 20 is therefore in one piece. The entire construction has a low weight and high stiffness.

The oil-deflecting plates 1 and 2 overlap in a strip-shaped manner in a region X by way of their longitudinal edges 6 and 34 which extend in the crankcase 23. In the region X, which, in plan view of the oil-deflecting device 20, is of essentially rectangular design, the first oil-deflecting plate 1 is guided at a distance below the second oil-deflecting plate 2. Arranged in the channel between the first oil-deflecting plate 1 and the second oil-deflecting plate 2 are ribs 19 which extend perpendicularly from the second oil-deflecting plate 2 to the first oil-deflecting plate 1. Stiffening elements 32 are arranged in a strip-shaped manner as an extension to the ribs 19 and alternating therewith. The stiffening elements 32 are guided in their length over the longitudinal edge 34 and extend as far as the border 52 of the second oil-deflecting plate 2.

Together with the first and second oil-deflecting plate 1, 2, the ribs 19 form channels 44 for guiding the oil-air flow coming off from the crank assemblies 26, in the direction Y of the suction point 11 of the oil pump. This directed oil-air flow makes it possible for the oil 9 to pass in the direction of the arrow Y to the suction point 11 of the oil pump in spite of the oil pan only having small run-off slopes, if any at all. The oil-deflecting device can therefore be of very flat design. The ribs 19 connect the first and second oil-deflecting plates 1, 2 forming a box-like structure, with the result that the oil-deflecting plates, which protrude by way of their respective longitudinal edges 34, 6 into the crankcase 23, are connected to one another in a flexurally rigid manner, and no further supporting points for the oil-deflecting device 20 formed in this way are necessary.

Figure 2:
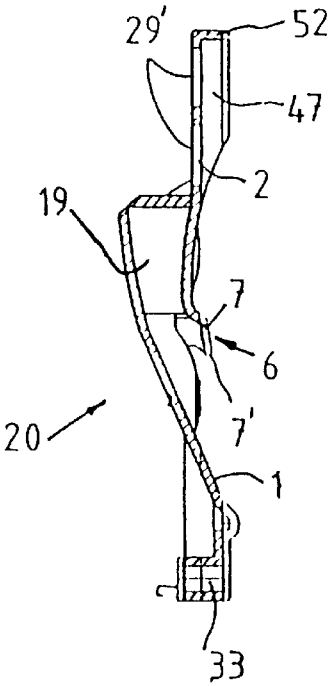
FIG. 2 shows a cross section through an arrangement along the line II—II in FIG. 1.
Figure 4:
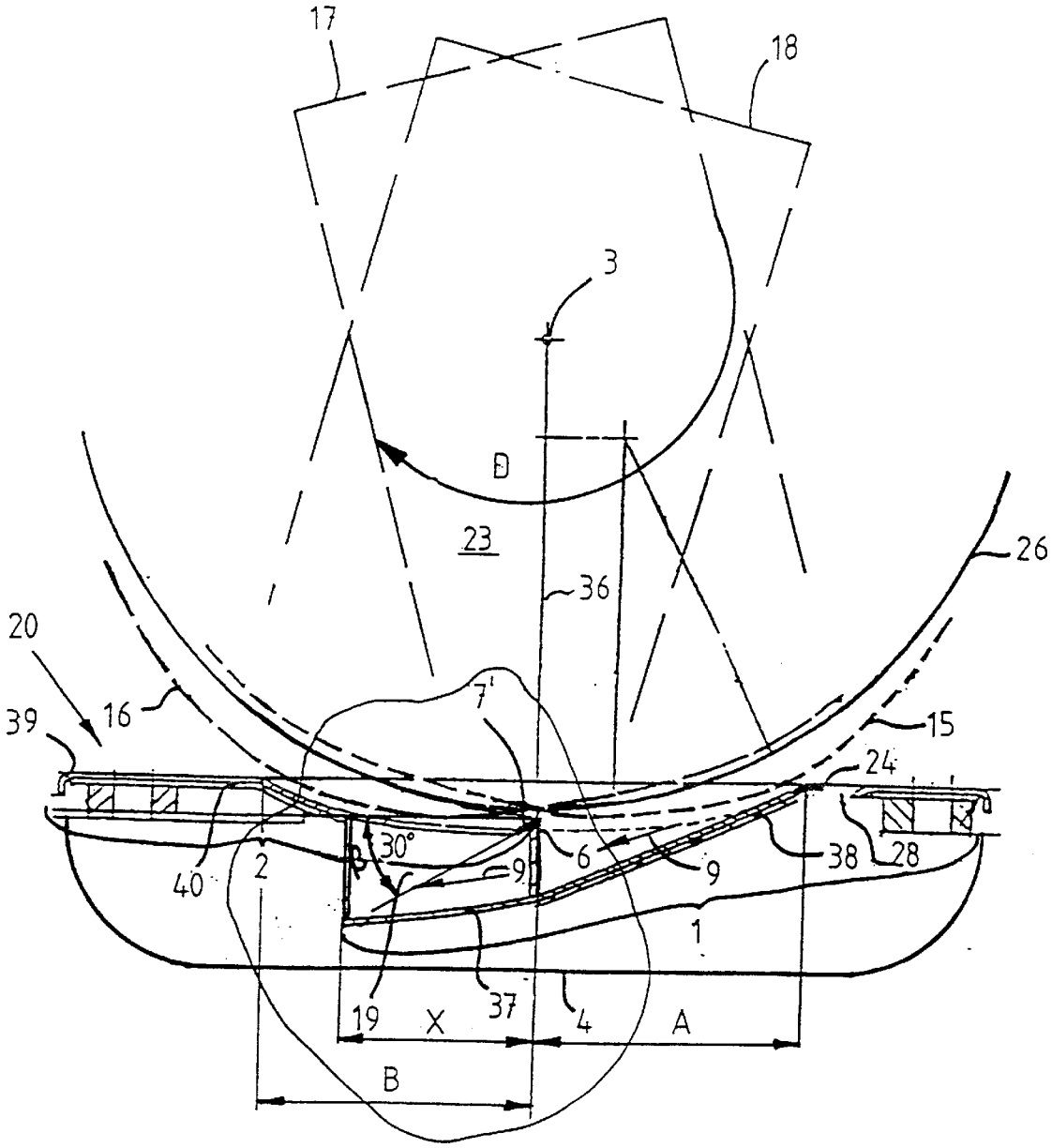
FIG. 4 shows a cross section through an arrangement along the line IV—IV in FIG. 3.

The longitudinal edge 6 of the second oil-deflecting plate 2 forms a main oil scraper edge 7 which, as FIG. 2 shows, runs tangentially to a counterweight radius 36, which is shown in FIG. 4, and is bent in the direction of the crankshaft of the internal combustion engine. The crankshaft extends in the direction of the double arrow Z.

The ribs 19 and the stiffening elements 32 are arranged over the length of the crankcase 23, preferably at identical distances apart, and extend at an angle $\alpha$, with respect to the main oil scraper edge 7, of preferably 35° towards the suction point 11 of the oil pump.

In the region of the crank assemblies, secondary oil scraper edges 24 can be mounted upstream of the main oil scraper edge 7, as viewed counter to the direction of rotation of the crankshaft. The secondary oil scraper edges 24 extend over the width of the crank assembly assigned in each case to them, and are formed by strip-shaped apertures 28 in the first oil-deflecting plate 1. The secondary oil scraper edges 24 are preferably aligned parallel to the main oil scraper edge 7, but may be arranged obliquely thereto. The secondary oil scraper edges 24 pass some of the oil coming off from the particular crank assembly to the oil pan.

Embedded in the first oil-deflecting plate 1 and opposite in the second oil-deflecting plate 2 between the apertures 28 of the first oil-deflecting plate 1 are oval depressions 47 (FIG. 2) which extend from the border 52 of the second oil-deflecting plate 2 and from the border 53 of the first oil-deflecting plate 1 towards the main oil scraper edge 7. The depressions 47 each bear two circular apertures 29, 29'. The depressions 47 form cutouts for the bearing shells of the crankshaft. The circular apertures 29, 29' serve as pressure-compensating openings between the oil pan and the crankcase, and also as installation openings.

The apertures 28 on the first oil-deflecting plate 1 are surrounded by U-shaped stiffening elements 30. If the oil-deflecting device 20 is designed as a casting or as a fiber composite part, the stiffening elements 30 are resigned as rib-like stiffenings on that side of the first oil-deflecting plate 1 which faces the oil pan. These rib-like stiffenings 30 are expediently guided around the depressions 47 of the first oil-deflecting plate 1. Guided on the borders 52 and 53 of the first and second oil-deflecting plates 1 and 2, at discrete distances apart, are through holes 33 which serve for accommodating a respective tie rod for securing the oil-deflecting device 20 to the engine block or to the oil pan. The oil-deflecting device 20 is thereby held between the oil pan and the engine block.

FIG. 2 shows a cross section through the oil-deflecting device along the lines II—II in FIG. 1. The oil-deflecting device 20 is formed by the first oil-deflecting plate 1 and the second oil-deflecting plate 2 and also the stiffening elements and the ribs 19. The first oil-deflecting plate 1 extends below the second oil-deflecting plate 2 and is designed as a one-piece component together with the stiffening elements and ribs 19. The same reference numbers as in FIG. 1 apply to the same components.

Figure 3:
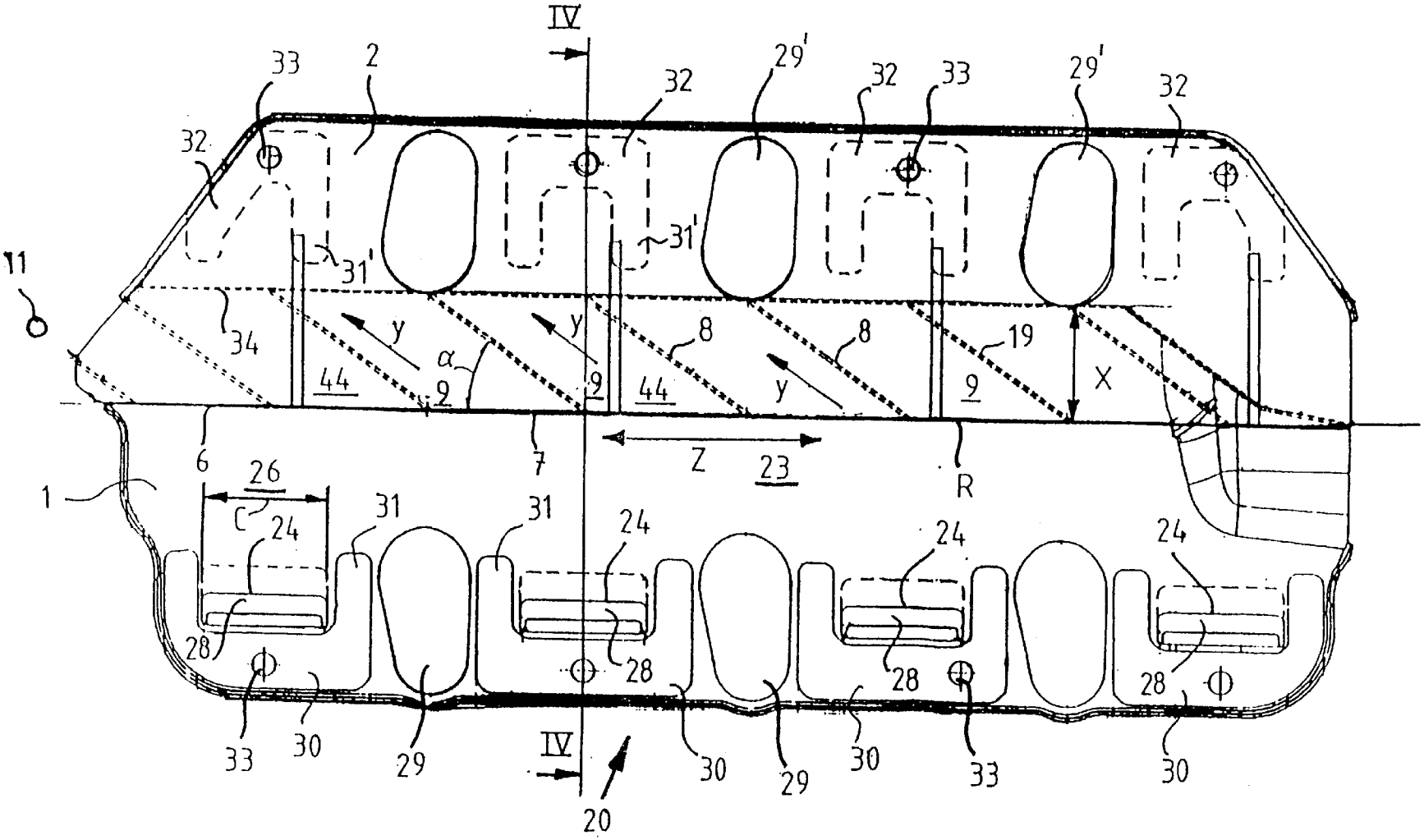
FIG. 3 shows a plan view of a second design of an oil-deflecting plate arrangement.

FIG. 3 shows a plan view of an oil-deflecting device 20 according to the invention which is assembled from a plurality of individual parts as a sheet-metal component. The oil-deflecting device 20 is essentially formed from a first oil-deflecting plate 1 and a second oil-deflecting plate 2. The oil-deflecting plates 1, 2 overlap in a strip-shaped manner in a region X by way of their longitudinal edges 6, 34 which extend in the crankcase 23. In this region X, the first oil-deflecting plate 1 is guided at a distance below the second oil-deflecting plate 2. Arranged in the channel between the first oil-deflecting plate 1 and the second oil-deflecting plate 2 are ribs 19 which extend vertically from the second oil-deflecting plate 2 to the first oil-deflecting plate 1. The ribs 19 are preferably arranged at equal distances apart over the length of the crankcase 23 and extend at an angle α, with respect to the longitudinal central axis R, of preferably 35° from the longitudinal edge 6 of the second oil-deflecting plate 2 towards the suction point 11 of the oil pump. Together with the first and second oil-deflecting plates 1, 2, the ribs 19 form channels 44 for the purpose of guiding the oil-air flow coming off from the crank assemblies 26 in the direction of the arrow Y to the suction point 11. This directed oil-air flow makes it possible for oil 9 to pass with the aid of this carrier air flow in the direction of the arrow Y to the suction point 11 of the oil pump despite the oil pan only having a small run-off slope, if at all. The oil-deflecting device can therefore be of very flat design. The ribs 19 connect the first and second oil-deflecting plates 1, 2 forming a box-like structure, with the result that the oil-deflecting plates which protrude into the crankcase 23 by way of their respective longitudinal edges 34, 6 are connected to one another in a flexurally rigid manner, and no further supporting points for the oil-deflecting device 20 formed in this manner are necessary.

The longitudinal edge 6 of the second oil-deflecting plate 2 forms a main oil scraper edge 7 which, as FIG. 4 shows, is angled through an angled edge strip 7', which runs at an angle β of preferably 30° with respect to the tangent on a counterweight radius 36, and is angled in the direction of the crankshaft of the internal combustion engine.

In the crank assemblies 26, secondary oil scraper edges, 24 can be mounted upstream of the main oil scraper edge 7, as viewed counter to the direction of rotation of the crankshaft 3. The secondary oil scraper edges 24 extend over a width C of the respective assigned crank assembly 26 and are formed by strip-shaped apertures 28 in the first oil-deflecting plate 1. The secondary oil scraper edges 24 are preferably aligned parallel to the longitudinal axis R of the oil scraper device 20 and to the axial direction Z of the crankshaft 3, and pass some of the oil coming off from the particular crank assembly 26 in the direction of the arrow Y to the oil pan.

The apertures 28 are surrounded by stiffening elements 30 which are U-shaped in outline and are attached to the first oil-deflecting plate 1. On both sides of the apertures 28, the legs 31 of the stiffening elements 30 are directed cowards the longitudinal central axis R of the oil-deflecting device 20. Stiffening elements 32 which are U-shaped in outline are situated opposite the stiffening elements 30, with respect to the longitudinal central axis R of the oil-deflecting device 20, on the second oil-deflecting plate 2. The legs 31' of these stiffening elements 32 point towards the longitudinal central axis R. A respective through hole 33 is guided through the stiffening elements 30, 32, the holes serving to accommodate a tie rod in each case for securing the oil-deflecting device 20 to the engine block. The oil-deflecting device 20 is held in this manner between the oil pan and the engine block. However, the oil-deflecting device can be held by the oil pan.

Oval apertures 29, 29' are stamped into the first and second oil-deflecting plates 1, 2 between the stiffening elements 30, 32 which are arranged at a distance from one another. The apertures 29, 29' serve to minimize the weight of the oil-deflecting device 20 and as pressure-compensating openings between the oil pan 4 and the crankcase 23. They also serve as installation openings and cutouts for the bearing shells of the crank assembly.

Figure 4A:
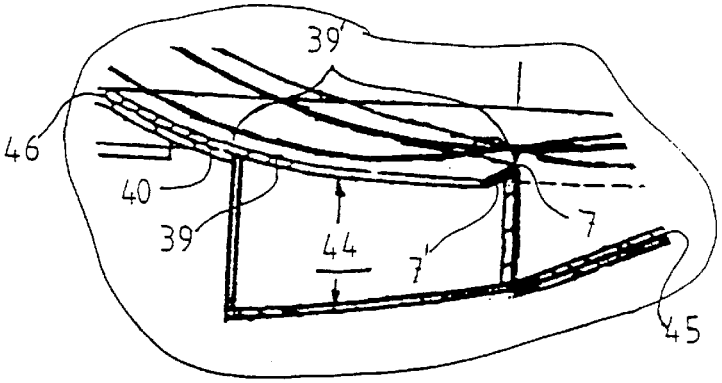
FIG. 4*a* shows an enlarged illustration of a detail in FIG. 4.

FIG. 4 shows a cross section through an oil-deflecting device 20 along the line IV—IV in FIG. 3, and FIG. 4*a* shows an enlarged illustration of a detail in FIG. 4. An oil-deflecting device 20 is arranged between an oil pan 4 and a crank assembly 26 (illustrated by a circular segment) in the crankcase 23. The internal combustion engine has V-arrangements of the cylinder banks 17, 18, which results in two connecting-rod arches 15, 16. The oil-deflecting device 20 is formed by the first oil-deflecting plate 1, which essentially consists of an upper plate layer 37 and a lower plate layer 38, and the second oil-deflecting plate 2, which consists of an upper plate layer 39 and a lower plate layer 40. The plate layers 37, 38 and 39, 40 are connected to one another on their contacting surfaces 45, 46 in a frictional manner. By way of their outer longitudinal edges, the oil-deflecting plates 1, 2 rest on the boundary of the oil pan 4. Proceeding from the boundary of the oil pan 4, both oil-deflecting plates 1, 2 are initially aligned essentially horizontally. The first oil-deflecting plate 1 is angled obliquely downwards at a short distance from the connecting-rod arch 15 and guided in the direction of the bottom of the oil pan in a region A, X. In a region B, the second oil-deflecting plate 2 is of a shape which approximately corresponds to the connecting-rod arch 16 and runs parallel to and at a short distance from the latter.

The oil-deflecting plates 1, 2 overlap in the region X, the first oil-deflecting plate 1 being guided below the second oil-deflecting plate 2. As already described, the distance is kept constant by the ribs 19 between the first oil-deflecting plate 1 and the second oil-deflecting plate 2. The ribs 19 can be metal plates which are, for example, welded to the two oil-deflecting plates 1, 2 or connected in a frictional manner by another suitable method. The oil can pass through the channel 44 into the oil pan 4 and continue to the suction point of the oil pump. The oil is separated both at the main oil scraper edge 7, which forms that longitudinal edge 6 of the second oil-deflecting plate 2 which is situated in the crankcase 23, and by secondary oil scraper edges 24. The secondary oil scraper edges 24 are in each case designed as the border of a strip-shaped aperture 28 in the first oil-deflecting plate 1 and are mounted upstream of the main oil scraper edge 7, as viewed counter to the direction of rotation D of the crankshaft 3.

FIG. 5 shows a plan view of an upper plate layer 39' of a multi-part oil-deflecting plate. The upper plate layer 39' is designed as a sheet-metal pressed part and is rectangular with an outline tapering in the shape of a tongue at a short edge. The main oil scraper edge 7 is essentially formed rectilinearly. Five strip-shaped beads 49 radiate out from the main oil scraper edge 7 at an angle α of 35°. The beads 49 serve to hold the ribs (not shown) in a form-fitting manner and are aligned approximately at the same distance from one another and parallel to one another. The upper plate layer 39' which is shown is fitted with suitable connecting means onto the upper plate layer 37 of the first oil-deflecting plate through holes 50, which are provided spaced apart along the border of the upper plate layer 39', and with the ribs 19 (FIG. 3). Using a plate layer 39' of this type it is, for example, possible to provide an oil-deflecting device as illustrated in FIG. 3 in such a manner that a first oil-deflecting plate 1 is produced in one piece together with ribs 19 of a lower plate layer 40 of the second oil-deflecting plate 2 and finally an upper plate layer 39' according to the invention is attached to this component.

FIG. 6 shows a cross section through the upper plate layer 39' along the line VI—VI in FIG. 5. The upper plate layer 39' is designed as a planar component, as shown in FIG. 6, having strip-shaped beads or depressions 49 which run diagonally over the upper plate layer 39' and have a depth t of approximately three times the thickness of the upper plate layer 39'. The depressions 49 have a width b of approximately three times the plate thickness of the upper plate layer 39'.

Figure 7:
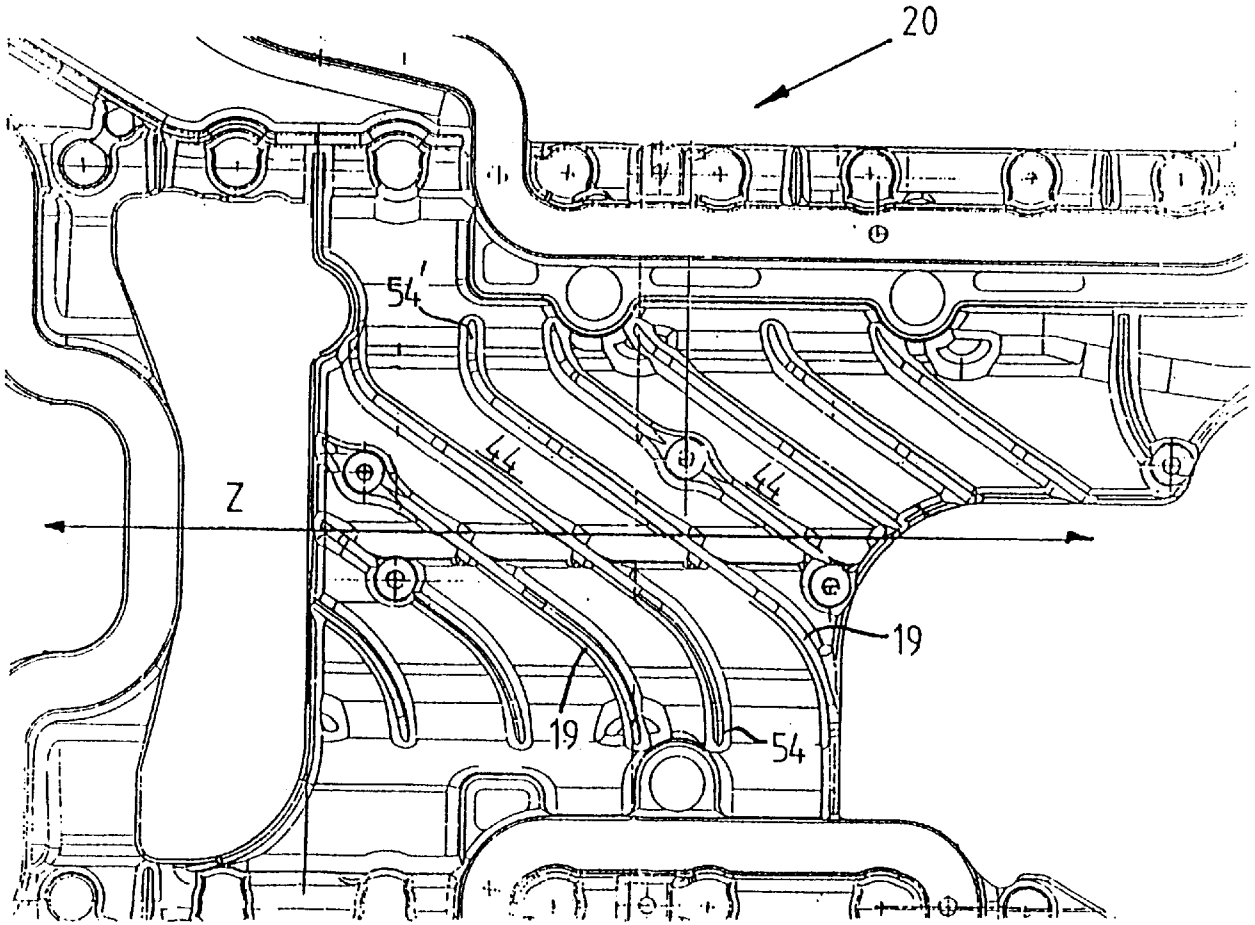
FIG. 7 shows a plan view of an oil-deflecting plate arrangement having curved ribs.

FIG. 7 shows a plan view of an oil-deflecting device with curved ribs 19. The oil-deflecting device 20 in FIG. 7 is used with correspondingly wide crank housings or oil pans. In order to conduct an oil-air flow over the large width (shown here) of the oil-deflecting device in as laminar a manner as possible, it is expedient to minimize the pressure losses in the channels 44 (cf. FIG. 1 and FIG. 3). For this purpose, the ends 54 and 54' of the ribs 19 are designed such that they are bent approximately perpendicularly with respect to the axial direction Z of the crankshaft and the ribs 19 curved between the ends 54, 54'. This structural measure makes it possible to minimize the pressure losses when introducing the oil-air flow into the channels 44 and removing it from them. The same reference numbers as in FIGS. 1 and 3 apply to the same components.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. Oil deflector for an oil pan of an internal combustion engine, comprising a first oil deflecting plate and a second oil-deflecting plate between a crankshaft and an oil pan, the oil-deflecting plates overlapping and forming a channel in a region, wherein at least one longitudinal edge of the second oil-deflecting plate forms a main oil scraper edge, wherein, in the region, the oil-deflecting plates overlap and an arrangement is provided between the oil-deflecting plates to guide oil in a direction of a suction point formed in the oil pan, wherein the arrangement provided to guide oil is formed by strip-shaped ribs which extend essentially vertically between the first oil-deflecting plate and the second oil-deflecting plate, wherein the oil-deflecting plates are connected to the ribs and therefore form an oil-deflecting device which can be handled as a combined component, and wherein the ribs are aligned at an angle of approximately 35° with respect to the axial direction of the crankshaft and a longitudinal central axis of the oil-deflecting device, and the oil is directed by the ribs to the suction point.

2. Oil deflector according to claim 1, wherein the distance between the ribs is approximately the same over the length of the crankcase.

3. Oil deflector according to claim 1, wherein the first oil-deflecting plate has secondary oil scraper edges which extend parallel to the longitudinal central axis of the oil-deflecting device in the region of the width of a respective crank assembly assigned thereto.

4. Oil deflector according to claim 3, wherein apertures are arranged between the secondary oil scraper edges of the first oil-deflecting plate.

5. Oil deflector according to claim 4, wherein said apertures are first apertures, and wherein second apertures on the second oil-deflecting plate are arranged lying opposite the first apertures with respect to the longitudinal central axis of the oil-deflecting device.

6. Oil deflector according to claim 3, wherein the secondary oil scraper edges are arranged upstream of the main oil scraper edge, as viewed in the direction of rotation of the crankshaft, and are formed by strip-shaped apertures in the first oil-deflecting plate.

7. Oil deflector according to claim 6, wherein the apertures forming the secondary oil scraper edges are surrounded by stiffening elements which are U-shaped in outline, are arranged on the first oil-deflecting plate, and are aligned with their legs towards the longitudinal central axis of the oil-deflecting device.

8. Oil deflector according to claim 7, and further comprising stiffening elements which are U-shaped in outline arranged with respect to the longitudinal central axis of the oil-deflecting device on the second oil-deflecting plate opposite the U-shaped stiffening elements of the first oil-deflecting plate.

9. Oil deflector according to claim 8, wherein through holes for tie rods are provided in the stiffening elements.

10. Oil deflector for an oil pan of an internal combustion engine, comprising a first oil deflecting plate and a second oil-deflecting plate between a crankshaft and an oil pan, the oil-deflecting plates overlapping and forming a channel in a region, wherein at least one longitudinal edge of the second oil-deflecting plate forms a main oil scraper edge, wherein, in the region, the oil-deflecting plates overlap and an arrangement is provided between the oil-deflecting plates to guide oil in a direction of a suction point formed in the oil pan, wherein the arrangement provided to guide oil is formed by strip-shaped ribs which extend essentially vertically between the first oil-deflecting plate and the second oil-deflecting plate, and wherein ends of the ribs are aligned approximately perpendicularly with respect to the axial direction of the crankshaft, and the ribs are curved between the ends.

11. Oil deflector for an oil pan of an internal combustion engine, comprising a first oil deflecting plate and a second oil-deflecting plate between a crankshaft and an oil pan, the oil-deflecting plates overlapping and forming a channel in a region, wherein at least one longitudinal edge of the second oil-deflecting plate forms a main oil scraper edge, wherein, in the region, the oil-deflecting plates overlap and an arrangement is provided between the oil-deflecting plates to guide oil in a direction of a suction point formed in the oil pan, wherein the arrangement provided to guide oil is formed by strip-shaped ribs which extend essentially vertically between the first oil-deflecting plate and the second oil-deflecting plate, wherein the oil-deflecting plates are connected to the ribs and therefore form an oil-deflecting device which can be handled as a combined component, and wherein the oil-deflecting device is formed from a fiber composite material.

12. Oil deflector for an oil pan of an internal combustion engine, comprising a first oil deflecting plate and a second oil-deflecting plate between a crankshaft and an oil pan, the oil-deflecting plates overlapping and forming a channel in a region, wherein at least one longitudinal edge of the second oil-deflecting plate forms a main oil scraper edge, wherein, in the region, the oil-deflecting plates overlap and an arrangement is provided between the oil-deflecting plates to guide oil in a direction of a suction point formed in the oil pan, wherein the arrangement provided to guide oil is formed by strip-shaped ribs which extend essentially vertically between the first oil-deflecting plate and the second oil-deflecting plate, wherein the oil-deflecting plates are connected to the ribs and therefore form an oil-deflecting device which can be handled as a combined component, wherein the oil-deflecting device is formed in one piece from light metal, and wherein, on the second oil-deflecting plate, stiffening elements, which are strip-shaped in outline, are guided from the ribs to a border of the second oil-deflecting plate.

* * * * *